US005551256A

United States Patent [19]

Schmidt

[11] Patent Number: 5,551,256

[45] Date of Patent: Sep. 3, 1996

[54] PROCESS FOR LIQUEFACTION OF NATURAL GAS

[75] Inventor: Hans Schmidt, Wolfratshausen, Germany

[73] Assignee: Linde Aktiengesellschaft, Wiesbaden, Germany

[21] Appl. No.: 556,195

[22] Filed: Nov. 9, 1995

[30] Foreign Application Priority Data

Nov. 11, 1994 [DE] Germany ..... 44 40 401.8

[51] Int. Cl.[6] ..... F25J 3/00

[52] U.S. Cl. ..... 62/614; 62/636; 62/912

[58] Field of Search ..... 62/614, 636, 912

[56] References Cited

U.S. PATENT DOCUMENTS 3,878,689 4/1975 Grenci ..... 62/614
4,133,663 1/1979 Skinner ..... 62/636
4,229,195 10/1980 Förg ..... 62/23
5,006,138 4/1991 Hewitt ..... 62/636

*Primary Examiner*—Ronald C. Capossela
*Attorney, Agent, or Firm*—Millen, White, Zelano, & Branigan, P.C.

[57] ABSTRACT

A pressurized natural gas flow, from which $CO_2$ and $H_2O$ are first removed using an adsorptive separation device, is subjected to liquefaction. The pre-purified natural gas flow is brought into heat exchange with at least one refrigerant routed in a refrigeration circuit and liquefied. The adsorptive separation device is regenerated by means of a regeneration gas containing a partial flow of the pre-purified natural gas flow and optionally additional residual gas flows such as a flash gas flow. During the cooling and liquefaction process of the natural gas flow at least the partial natural gas flow needed-for regeneration of the adsorptive separation device is separated when the temperature of the partial flow is such that the efficiency of cold use can be maximized by throttling to the regeneration gas pressure.

13 Claims, 1 Drawing Sheet

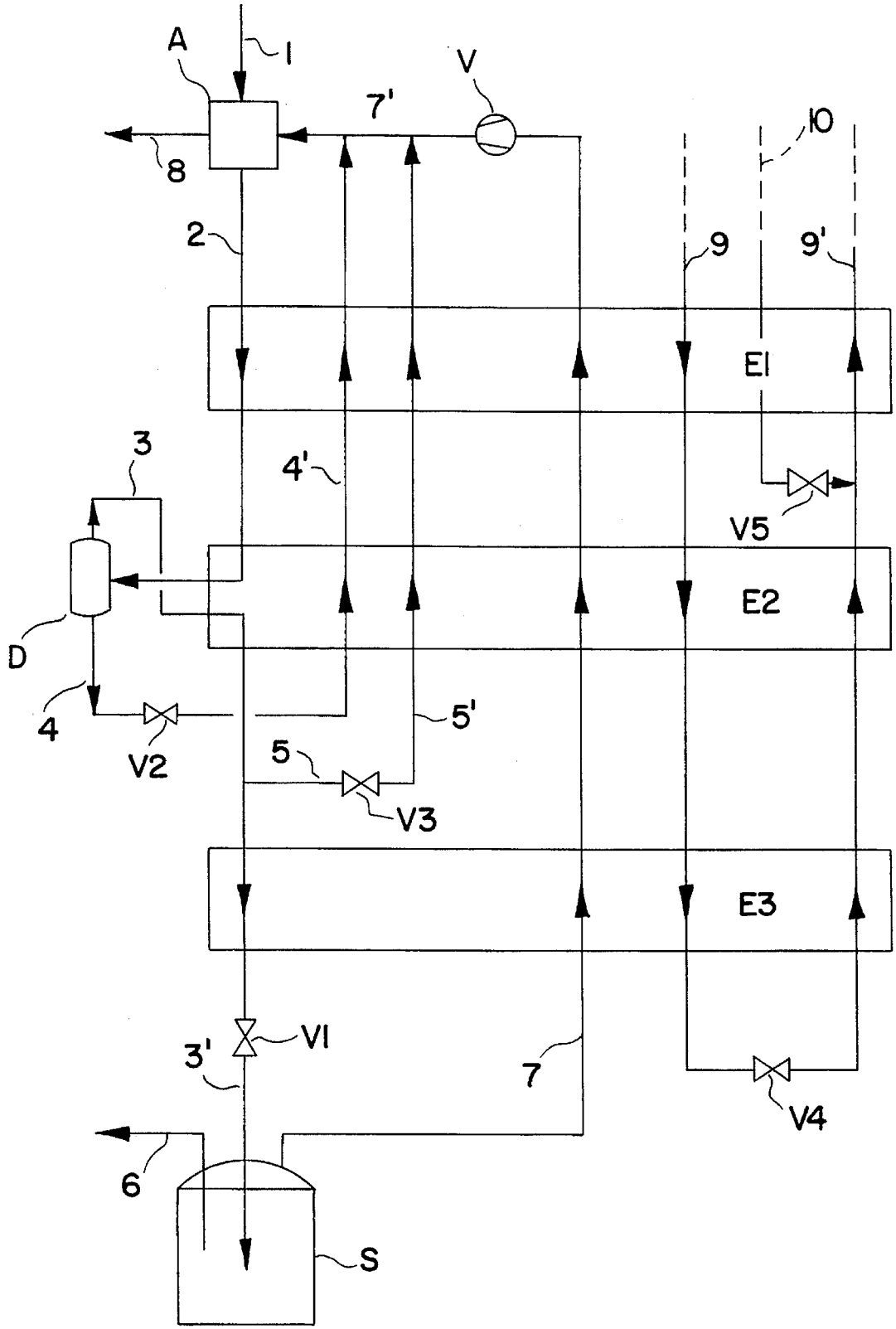
A
1
V
7'
10
8
2
9
9'
E1
3
4'
V5
E2
D
4
V2
5'
5
V3
E3
3'
V1
7
V4
6
S

PROCESS FOR LIQUEFACTION OF NATURAL GAS

SUMMARY OF THE INVENTION

The invention relates to a process for liquefaction of a pressurized natural gas stream in which $CO_2$ and $H_2O$ are first removed from the natural gas stream using an adsorptive separation device and the prepurified natural gas stream is then brought into heat exchange, with at least one refrigerant circulated in a refrigeration circuit, and liquefied. The adsorptive separation device is regenerated by means of a regeneration gas containing a partial flow of pre-purified natural gas and optionally additional residual gas flows such as, for example, a tank return gas stream.

Processes for liquefaction of a pressurized natural gas flow are known. See, for example, from DE-OS 28 20 212 (see also U.S. Pat. No. 4,229,195). In this known process pressurized natural gas flow is brought into heat exchange with two refrigerants. These refrigerants are each circulated in closed circuits, compressed, at least partially liquefied, and expanded. The refrigerant of the first circuit is used for precooling the natural gas and for cooling the refrigerant of the second circuit. The latter is used for liquefaction of the precooled natural gas. The liquefied natural gas is then expanded and, after precooling, divided into two partial flows, one of which is liquefied by heat exchange with the refrigerant of the second circuit and the other is liquefied by heat exchange with the flash gas formed when the liquefied natural gas is expanded. The flash gas is compressed after heat exchange with precooled natural gas, at least partially liquefied in heat exchange with the refrigerants of the first and the second circuits and subsequently expanded again.

Generally, natural gas contains methane, small portions of ethane, propane, and higher boiling hydrocarbons as well as small amounts of nitrogen, carbon dioxide and water. Before cooling and liquefaction, all those components which freeze out during cooling and liquefaction and thus could lead to blockages in lines and valves are separated from the natural gas. This is feasibly done by means of an adsorptive separation device. In such a device, carbon dioxide and water can be removed, except for very small residual amounts, so that there is no longer any danger of these components freezing out in the low temperature part of the process.

The adsorption means used, preferably a molecular sieve bed, can however be cyclically regenerated. To do this, as proposed in DE-OS 28 20 212, a partial flow of flash gas can be used, by which the preparation of a special regeneration gas becomes superfluous. The loaded regeneration gas withdrawn from the regenerated adsorber can then be burned due to its composition to, for example, drive a gas turbine. Often also part of the natural gas flow discharged from the adsorptive separation device can be used as the regeneration gas.

An object of the invention is to provide a process for liquefaction of a pressurized natural gas flow which, compared to the known process, has an improved energy balance.

Upon further study of the specification and appended claims, further objects and advantages of this invention will become apparent to those skilled in the art.

These objects are achieved according to the invention by, during cooling and liquefaction of the natural gas stream, separating at least a partial natural gas flow to be used for regeneration of an adsorptive separation zone at a point wherein the temperature of the partial flow is such that the efficiency of cold use can be maximized by throttling the partial stream to the regeneration pressure.

In accordance with an embodiment of the invention, a process for liquefaction of a pressurized natural gas feedstream is provided, wherein:

$CO_2$ and $H_2O$ is removed from a pressurized natural gas stream in an adsorptive separation zone;

the resultant pre-purified natural gas stream is brought into heat exchange with at least one refrigerant in a refrigeration circuit and liquefied;

the adsorptive separation zone is regenerated using a regeneration gas containing a partial flow of the pre-purified natural gas stream; and during cooling and liquefaction of the natural gas stream, the partial flow of pre-purified natural gas used for regeneration of the adsorptive separation zone is separated from the pre-purified natural gas stream and expanded to regeneration pressure;

whereby the partial flow of pre-purified natural gas is cooled and, prior to introduction into the adsorption zone, the cooled partial flow of pre-purified natural gas is heated by heat exchange with the natural gas stream.

BRIEF DESCRIPTION OF THE DRAWING

Various other objects, features and attendant advantages of the present invention will be more fully appreciated as the same becomes better understood when considered in conjunction with the accompanying drawing:

FIG. 1 illustrates an embodiment of the process according to the invention.

DETAILED DESCRIPTION

The embodiments of the invention are explained using the Figure.

The process for cooling and liquefaction of natural gas employs a pressurized natural gas stream having a pressure of, for example, 20–70 bar, and a temperature of, for example, 20°–40° C. The natural gas feed stream generally contains, for example, methane, ethane, propane and higher boiling hydrocarbon components (e.g., $C_{3+}$ hydrocarbons and aromatics), as well as amounts of $N_2$, $CO_2$ and/or $H_2O$.

Via line 1, a natural gas stream containing, for example, 1.0 mole % $N_2$, 94.0 mole % methane, 2.0 mole ethane, 1.22 mole % $C_{3+}$ hydrocarbons, 1.75 mole % carbon dioxide and 0.03 mole % water at a temperature of 18° C. and a pressure of 42 bar is supplied to an adsorption zone A. The latter comprises at least two adsorbers arranged parallel to one another which cyclically pass through adsorption and regeneration phases. Thus, in the case of the adsorbers, one can be undergoing adsorption while the other is undergoing regeneration/desorption.

The pre-purified natural gas flow containing 50 ppm $CO_2$ and <1 ppm $H_2O$ is discharged from adsorption zone A at a temperature of 38° C. and a pressure of 40 bar and is passed via line 2 through heat exchangers E1 and E2. The natural gas flow, now cooled to −73° C., is then supplied to separator D. In separator D, aromatics and heavy hydrocarbons, preferably $C_{3+}$ hydrocarbons, are separated from the prepurified natural gas stream. This separation of aromatics and heavy hydrocarbons is performed to prevent these components from freezing out during expansion or further cooling.

The aromatic and heavy hydrocarbon fraction is withdrawn via line 4 from separator D, expanded for purposes of refrigeration in valve V2 and then subjected to indirect heat exchange with the natural gas stream to be cooled in line 2 by passage via line 4' through heat exchangers E2 and E1. This fraction flowing in line 4' contains 61.0 mole % methane, 12.0 mole ethane, 10.0 mole % propane and 17.0. mole % $C_{4+}$ hydrocarbons. At the outlet of heat exchanger E1, this fraction has a temperature of 36° C. and a pressure of 9 bar. It is now introduced into line 7' which will be detailed later.

The natural gas stream, from which the aromatics and heavy hydrocarbons have been removed, and which contains 1.0 mole % nitrogen, 97.0 mole % methane, 1.8 mole % ethane, and 0.2 mole % $C_{3+}$ hydrocarbons, is withdrawn via line 3 from the top of separator D and further cooled, liquefied and supercooled in heat exchangers E2 and E3. At the outlet of heat exchanger E3, this fraction has a pressure of 39.6 bar and a temperature of −133° C. At this point, expansion in valve V1 occurs and the natural gas fraction is thereafter delivered to storage tank S, via line 3', at atmospheric pressure and a temperature of −161° C. From the storage tank, liquefied natural gas can be withdrawn via line 6.

The tank return gas which forms within storage tank S is removed from it via line 7 and routed, in counterflow to the natural gas flow to be cooled, through heat exchangers E3, E2, and E1. At the outlet of heat exchanger E1, the flash gas stream is compressed to desired regeneration pressure of 9 bar by means of compressor V. The compressed flash gas is then supplied via line 7' to the adsorber(s) of adsorption zone A to regenerate the adsorber(s).

The aromatic and/or heavy hydrocarbon fraction routed by means of line 4' through heat exchangers E2 and E1 is added to this compressed flash gas, as already mentioned. The two fractions delivered via line 4' and 7' may not, however, completely cover the regeneration gas requirement. For this reason, some of the pre-purified natural gas flow can be used for regeneration purposes.

In the process according to the invention the partial natural gas flow used for this purpose is withdrawn between the two heat exchangers E2 and E3. The withdrawal site should be selected with respect to temperature such that the efficiency of cold use is maximized as a result of expansion of the partial natural gas flow to the desired regeneration gas pressure.

The partial natural gas flow is removed via line 5, expanded in valve V3 using the Joule-Thompson effect for refrigeration purposes, and then passed by means of line 5' in counterflow to the natural gas flow to be cooled through heat exchangers E2 and E1. The partial natural gas flow branched off via line 5 in front of expansion valve V3 has a temperature of −126° C. and a pressure of 39.7 bar. In valve V3, expansion to 9.3 bar takes place.

At the outlet of heat exchanger E1, the partial flow in line 5' has a temperature of 36° C. and is supplied via line 7' to adsorption device A as regeneration gas. After completion of regeneration, the regeneration gas is withdrawn via line 8 from adsorption zone A.

The amount of cold needed for cooling and liquefaction of the natural gas flow is covered by means of an additional refrigeration circuit. This refrigeration circuit is only shown schematically here. Via lines 9 and 10 the refrigerant or refrigerant mixture for cooling and partial liquefaction is routed through heat exchangers E1, E2, and E3 or is routed through heat exchanger E1, expanded for refrigeration purposes in expansion valves V4 and V5 and finally routed in counterflow to the natural gas flow to be cooled by means of line 9' through heat exchangers E3, E2 and E1. Line 9 is a vapor refrigerant line and line 10 is a liquid refrigerant line. As refrigerants, mixtures of nitrogen and methane or mixtures of nitrogen, methane and $C_2$ through $C_5$ hydrocarbons have proven effective. These refrigeration circuits are known within the art and this need not be detailed here.

It is also possible to use the aromatic and higher hydrocarbon-rich flow withdrawn at the bottom of separator D as the partial natural gas flow used for regeneration of adsorption zone A. This is possible when the content of aromatics and higher hydrocarbons of the natural gas flow leaving adsorption zone A is so low that, when cooled to the temperature which makes expansion to regeneration gas pressure feasible, these components do not freeze out upstream of separator D or after expansion valve V2 which would lead to blockages in the lines. Generally, for safety reasons, separator D is designed to operate at a temperature level which also enables separation of a larger amount of aromatics and higher hydrocarbons.

Of course it is also conceivable to separate not only the amount of the partial natural gas flow used to regenerate the adsorption zone, but the maximum amount which can be routed to an optionally present low pressure network. The amount of the partial natural gas flow separated from the natural gas flow therefore depends on the boundary conditions, for example, an existing low pressure network, etc.

By means of the process according to the invention, the pressure gradient between the natural gas pressure and the regeneration gas pressure can be used as a source of cold. This results in reducing the energy required for the refrigeration circuit so that the specific energy consumption for liquefying the natural gas is reduced. Besides the investment costs, the specific energy demand is the determining factor for these processes. Since the Joule-Thompson effect provides a greater temperature difference than in known processes, wherein some of the natural gas stream is withdrawn from a point directly downstream of a cyclic pressure adsorption device A and used for regeneration purposes, the required heat exchange surface is smaller in spite of slightly increased heat conversion. In this way the costs for the heat exchangers in the cold part of the process are also reduced.

In summary it can be stated that the process according to the invention leads to a reduction of the specific energy consumption without added cost for investment. The savings in energy consumption is directly proportional to the partial flow amount which is expanded using the Joule-Thompson effect.

Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

In the foregoing, all temperatures are set forth uncorrected in degrees Celsius and unless otherwise indicated, all parts and percentages are by weight.

The entire disclosure of all applications, patents and publications, cited above, and of corresponding German application P 44 40 401.8, filed Nov. 11, 1994, are hereby incorporated by reference.

The preceding can be repeated with similar success by substituting the generically or specifically described reactants and/or operating conditions of this invention for those used therein.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for liquefaction of a pressurized natural gas feedstream, said process comprising:

removing $CO_2$ and $H_2O$ from a pressurized natural gas stream in an adsorptive separation zone;

bringing the resultant pre-purified natural gas stream into heat exchange with at least one refrigerant in a refrigeration circuit and liquefying said pre-purified natural gas stream; and regenerating said adsorptive separation zone using a regeneration gas containing a partial flow of said pre-purified natural gas stream;

wherein, during cooling and liquefaction of said pre-purified natural gas stream, said partial flow of pre-purified natural gas used for regeneration of said adsorptive separation zone is separated from said pre-purified natural gas stream and expanded to regeneration pressure;

whereby said partial flow of pre-purified natural gas is cooled and, prior to introduction into said adsorption zone, the cooled partial flow of prepurified natural gas is heated by heat exchange with said natural gas stream.

2. A process according to claim 1, wherein, after separation of said partial flow of pre-purified natural gas from said natural gas stream, the latter is further cooled and liquefied, and then expanded before introduction into a storage tank.

3. A process according to claim 2, wherein tank return gas is removed from said storage tank, compressed and combined with said partial flow of prepurified natural gas, and the resultant gas mixture is used to regenerate said adsorptive separation zone.

4. A process according to claim 3, wherein, prior to being combined with said partial flow of pre-purified natural gas, said tank return gas is heated by heat exchange with said pre-purified natural gas stream.

5. A process according to claim 4, wherein, during cooling and liquefaction, said natural gas stream is delivered to a separator, a $C_+$ hydrocarbon stream is removed from the bottom of said separator, and said pre-purified natural gas stream is removed from the top of said separator.

6. A process according to claim 5, wherein said $C_{3+}$ hydrocarbon stream is expanded and then heated by heat exchange with said pre-purified natural gas stream.

7. A process according to claim 6, wherein, after said heat exchange with said pre-purified natural gas stream, said $C_{3+}$ hydrocarbon stream is combined with said partial flow of pre-purified natural gas and said flash gas and the resultant mixture is used to regenerate said adsorptive separation zone.

8. A process according to claim 1, wherein, during cooling and liquefaction, said natural gas stream is delivered to a separator, a $C_{3+}$ hydrocarbon stream is removed from the bottom of said separator, and said pre-purified natural gas stream is removed from the top of said separator.

9. A process according to claim 8, wherein said $C_{3+}$ hydrocarbon stream is expanded and then heated by heat exchange with said pre-purified natural gas stream.

10. A process according to claim 9, wherein, after said heat exchange with said pre-purified natural gas stream, said $C_{3+}$ hydrocarbon stream is combined with said partial flow of pre-purified natural gas and the resultant mixture is used to regenerate said adsorptive separation zone.

11. A process according to claim 3, wherein, during cooling and liquefaction, said pre-purified natural gas stream is delivered to a separator, a $C_{3+}$ hydrocarbon stream is removed from the bottom of said separator, and said pre-purified natural gas stream is removed from the top of said separator.

12. A process according to claim 11, wherein said $C_{3+}$ hydrocarbon stream is expanded and then heated by heat exchange with said pre-purified natural gas stream.

13. A process according to claim 12, wherein, after said heat exchange with said pre-purified natural gas stream, said $C_{3+}$ hydrocarbon stream is combined with said partial flow of pre-purified natural gas and said flash gas and the resultant mixture is used to regenerate said adsorptive separation zone.

* * * * *